United States Patent [19]

Morrone

[11] 4,236,768

[45] Dec. 2, 1980

[54] RECORD ALBUM FILING CABINET

[76] Inventor: James V. Morrone, 25 Sea Foam Ave., Winthrop, Mass. 02152

[21] Appl. No.: 17,482

[22] Filed: Mar. 5, 1979

[51] Int. Cl.[3] ..... A47B 81/00

[52] U.S. Cl. ..... 312/10; 211/40; 211/50; 312/234.1

[58] Field of Search ..... 312/9, 10, 12, 234.1, 312/234.2, 234.4, 320; 211/10, 11, 40, 50

[56] References Cited

U.S. PATENT DOCUMENTS

| | | | |
|---|---|---|---|
| 989,031 | 4/1911 | Oliver | 312/12 |
| 1,590,148 | 6/1926 | Bergdel | 312/10 |
| 4,082,385 | 4/1978 | Morrone | 312/10 |

*Primary Examiner*—Casmir A. Nunberg

*Attorney, Agent, or Firm*—Wolf, Greenfield & Sacks

[57] ABSTRACT

The cabinet has a plurality of parallel arranged shelves each for accommodating a record album and including means wherein a record may be easily selected for use and easily returned to its original predetermined position in the cabinet. When the record is in its jacket selection is by means of a notch provided in each shelf. When the record is stored without a jacket the cabinet is constructed with slidable shelves which may be withdrawn for selection of the record.

10 Claims, 3 Drawing Figures

3
17
16

3
18
36
22
14
22
20
18'
46
20
12
38
40
2
2
18
22
36

30

50
50
46
12
14
38
36
26
25
24
22
42
20

RECORD ALBUM FILING CABINET

BACKGROUND AND SUMMARY OF THE INVENTION

The present invention relates to the field of record album cabinets, and, more particularly, to cabinets for storage of a plurality of records usually stored in a record jacket and wherein these record albums are easily selectable and returnable to the cabinet. In the disclosed embodiment herein the technique of returning the record album to the cabinet may be of the same type as described in my previous U.S. Pat. No. 4,082,385. However, it is understood that the principles of the present invention may also be used in association with other cabinet constructions.

U.S. Pat. No. 4,082,385 describes a shelf arrangement having a staggered tab feature which enables each record in its album jacket to be returned to an original predetermined position on a particular shelf in the cabinet. Although the cabinet described in this prior art patent operates quite effectively and quite suitably, there are some disadvantages associated therewith. For example, my prior art patent teaches the withdrawal of the record from the opposite side or usually from the rear of the cabinet. This may not be convenient especially if the cabinet is to be positioned against a wall. Also, if the record does not have a jacket, which is the case many times, then it may be difficult to obtain a sufficient grip on the record to withdraw it easily.

Accordingly, one object of the present invention is to provide an improved record album filing cabinet which permits selection and return of the record from the same side of the cabinet which preferably is from the front of the cabinet.

Another object of the present invention is to provide an improved record album filing cabinet wherein a record without its jacket may be readily removed from the cabinet.

A further object of the present invention is to provide an improved record album filing cabinet that may also be characterized, in combination with the above objects, as having means for making certain that each record is returned to its proper predetermined position in the cabinet.

To accomplish the foregoing and other objects of this invention there is provided a cabinet for filing records either alone or in a record jacket. This cabinet comprises a body having sidewalls, preferably a top wall and a plurality of shelves secured between the sidewalls and preferably in spaced parallel relationship to each other. These shelves are preferably spaced a distance apart slightly greater than the record album which is to be filed. Each of these shelves may have an extending tab with each tab being of a different width for facilitating return of the record album to the proper position in the cabinet. The tab cooperates with a clip on the record album. In order to provide selection from the same side as the record was returned there are provided a series of notches one in each shelf which permits the user to insert his thumb or one of his fingers to withdraw the record album. Preferably the depth of a shelf is the same as the depth of the record jacket so that a corner of the jacket is exposed in each notch. Also, preferably all of the notches are lined in a vertical sense and are disposed adjacent one of the shelves.

Many times the record jacket is misplaced and thus records must be stored without any jacket. Because in the preferred embodiment the cabinet is sqaure to accommodate these jackets and the record is round access to the record alone is not possible by means of the notch. Thus, in accordance with another important feature of the present invention each of the shelves is made slidable so that the shelf can be withdrawn at least partially to expose the record which then can be removed from its shelf.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
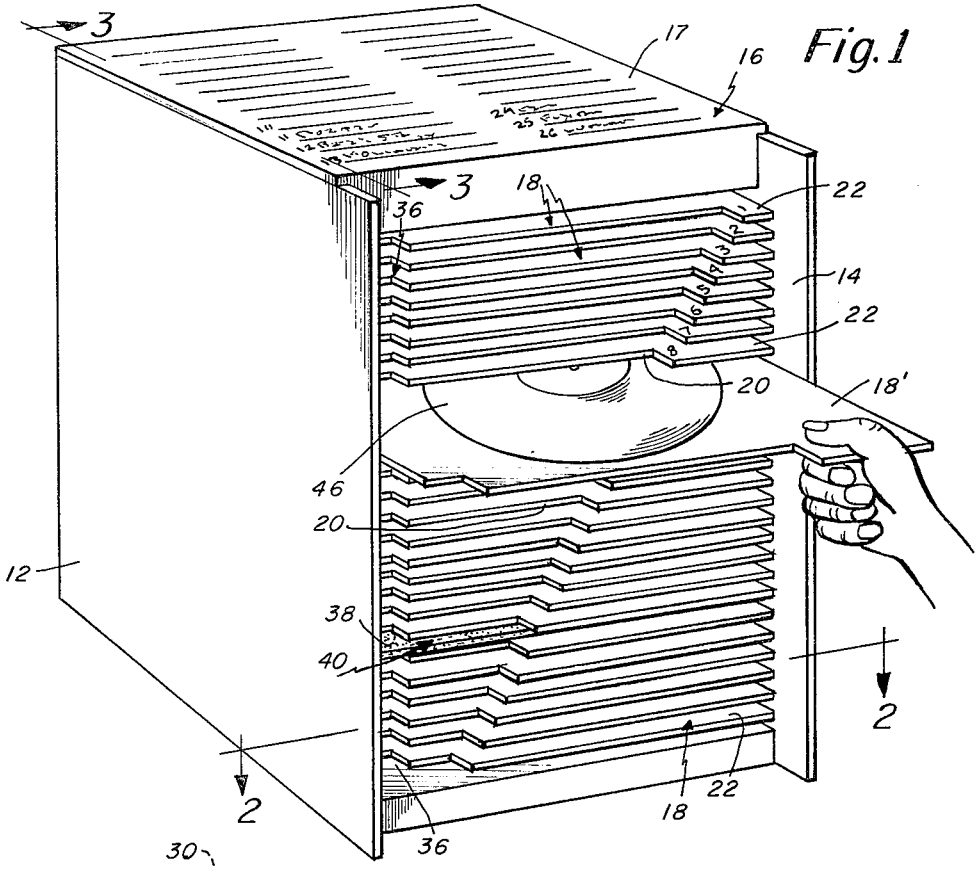
FIG. 1 is a perspective view of a cabinet constructed in accordance with the principles of this invention.

The cabinet described in the drawings comprises vertical sidewalls 12 and 14 and a top 16 which is secured by any suitable means to the top ends of the sidewalls 12 and 14 to assist in maintaining the sidewalls in a vertical and parallel position. A plurality of shelves 18 are also provided and are disposed in horizontally spaced relation with each other and connected between the sidewalls 12 and 14 as shown in the drawing. The cabinet may be made from wood or plastic or any other suitable material. Each of the shelves is defined at its front edge by a cutout portion 20 and an extending substantially rectangular tab 22. As is apparent from FIG. 1 the cutout portions in each shelf from the top shelf to the bottom shelf become progressively shorter in their lateral dimensions. This arrangement is substantially the same as shown in my previous U.S. Pat. No. 4,082,385.

The cabinet shown in drawings is primarily for the purpose of storing or filing phonograph record albums and consequently the width of the cabinet is just slightly greater than the width of the conventional standard record album jackets. The depth of the cabinet is greater than the length of the jacket because of the use of a clip 30 secured to the jacket and discussed in more detail hereinafter. The cabinet described in the drawings may hold up to 26 albums. Of course, the number of albums that can be stored may be greater or less than that amount depending upon the amount of staggering provided between adjacent shelves; that is the staggering provided by the tabs 22. The shelves are preferably spaced vertically from one another a distance slightly greater than the thickness of each album.

Figure 2:
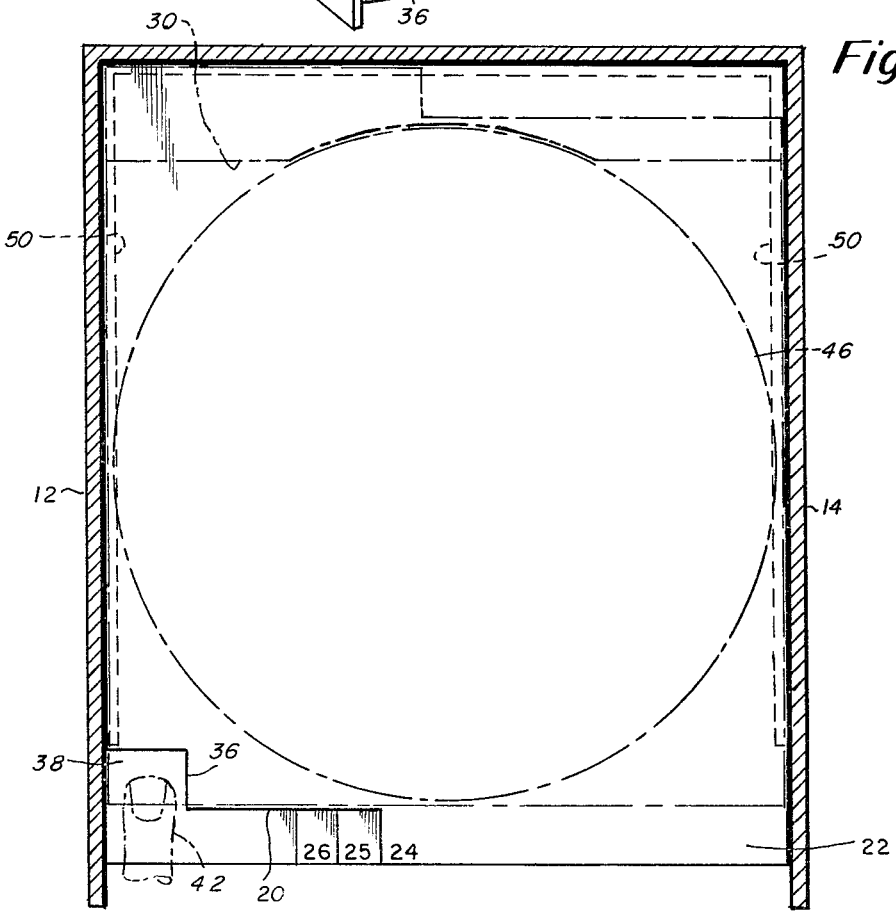
FIG. 2 is a cross-sectional plan view through the cabinet as taken along line 2—2 of FIG. 1.

FIG. 2 illustrates the clip 30 arranged to snugly slip onto the record jacket. A clip may be provided for each album jacket with the width of each clip also being staggered in the manner taught in my previously issued U.S. Pat. No. 4,082,385. Thus, the series of clips that are used each have a cutout portion of a dimension slightly greater than the width of a tab in the series of shelves. In this way the jacket with the clip attached is directed toward the front of the cabinet, inserted partially, and permitted to drop into place on the shelf until the extended portion of the clip rests on a particular tab. In this manner a single particular shelf is selected and the jacket is slipped onto that shelf. In order to provide the selection at the front of the cabinet each of the shelves 18 is provided with a notch 36. As denoted in FIG. 2 the notch 36 is at the left side of the shelf viewing the shelf as in FIG. 1. Preferably, the depth of the shelf 18 is preferably about the same as the depth of the jacket with the clip 30 so that in the position of FIG. 2 there is a portion 38 of the jacket 40 that is exposed. In FIG. 2 there is shown at 42 the outline of a thumb or finger on the portion 38. By grasping the portion 38 the entire jacket with the record 46 therein may be withdrawn from the shelf.

The top 16 of the cabinet has a top surface 17 that may have thereon identification for each of the record albums held by the cabinet. For example, in FIG. 1 each of the shelves are numerically identified and there is a like numerical identification on the top surface 17. In this way the record that is on say the first shelf which is numbered shelf number 1 may be identified in a position number 1 on the surface 17. The identification may be in the form of the name of the album and possibly the performer.

Figure 3:
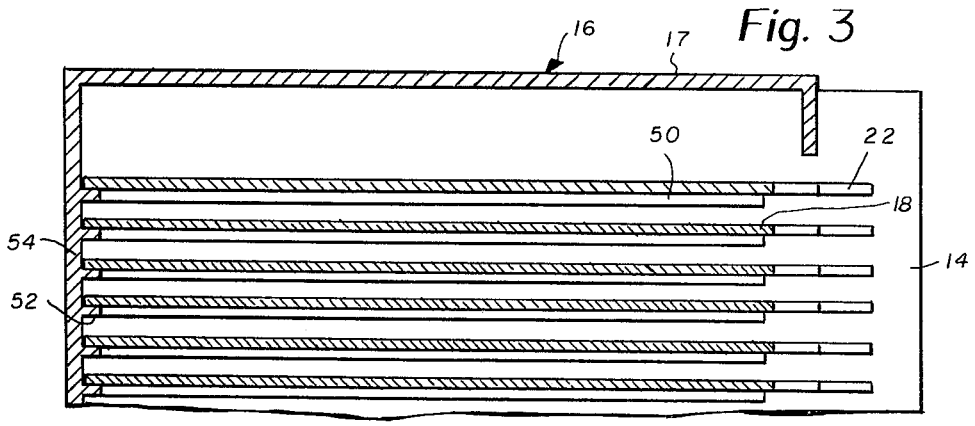
FIG. 3 is a fragmentary cross-sectional view at the top of the cabinet taken along line 3—3 of FIG. 1.

Many times the record jacket is misplaced and thus the record 46 itself has to be stored. It is apparent from FIG. 1 that the notch 36 in the partially withdrawn shelf 18' would not permit access to the record 46. Accordingly, in accordance with another feature of the invention the shelves 18 are made slidable by means of a ledge or rib 50 that is securely fixed to the inner surface of the sidewalls 12 and 14. There is, of course, a ledge 50 secured to the inner surface of sidewalls on both sides as depicted in FIG. 2. Also, there may be a rear ledge 52 secured to the rear wall 54 as depicted in FIG. 3. In this way the shelves simply rest upon the ledges and can be easily withdrawn. FIG. 1 shows the shelf 18' being withdrawn to expose the record 46 so that the record can be removed.

What is claimed is:

1. A cabinet for filing phonograph records or the like comprising a body having sidewalls and a top, and a plurality of shelves positioned between the sidewalls in spaced parallel relation to each other a distance apart greater than the record thickness, each of said shelves having notch means providing access to an exposed edge of the record or record jacket, and means slideably supporting the shelves to permit the shelves to each be manually withdrawn to expose a record without jacket.

2. A cabinet as set forth in claim 1 wherein each shelf has an extended tab portion along the front edge, each tab from top to bottom being of slightly greater width than the preceding tab, a plurality of folders each of cutout portion along one edge slightly greater in length than the width of the tab on a particular shelf whereby a folder presented to the cabinet for filing will fall onto an adjacent shelf wherein the length of the cutout portion is less than the width of the tab on that shelf, thus each folder may be returned to its proper shelf after use.

3. A cabinet as defined in claim 2 wherein a clip is provided and detachably secured to each folder or jacket, and each clip has a cutout portion of a length substantially greater than the width of the tab of the particular shelf.

4. A cabinet as set forth in claim 1 wherein the notch means comprise a notch on each shelf with all notches arranged along a vertical path.

5. A cabinet as set forth in claim 4 including a tab on each shelf, the notch on one side of the shelf and the tab on the other.

6. A cabinet as set forth in claim 1 wherein the means slideably supporting includes a ledge for each shelf.

7. A cabinet as set forth in claim 5 wherein said tab provides a locating means for each record and a means for manually withdrawing each shelf.

8. A cabinet as set forth in claim 1 including corresponding indicia, one on each shelf to distinctively identify the shelf and one elsewhere on the cabinet.

9. A cabinet as set forth in claim 8 wherein one of the indicia is on the top surface of the cabinet, said indicia identifying the record.

10. A cabinet as set forth in claim 1 including a rear wall of the cabinet for limiting the rearward position of the record jacket, said notch means comprising a notch in the shelf having an inner edge formed a distance from the rear wall less than the depth of the record jacket to thus expose a piece of the record jacket.

* * * * *